US009033540B1

(12) United States Patent
McCorkle

(10) Patent No.: US 9,033,540 B1
(45) Date of Patent: May 19, 2015

(54) FLASHLIGHT MOUNT

(71) Applicant: Christopher McCorkle, Scottsdale, AZ (US)

(72) Inventor: Christopher McCorkle, Scottsdale, AZ (US)

(73) Assignee: 1445 Designs Corporation, Scottsdale, AZ (US)

( * ) Notice: Subject to any disclaimer, the term of this patent is extended or adjusted under 35 U.S.C. 154(b) by 0 days.

(21) Appl. No.: 13/834,761

(22) Filed: Mar. 15, 2013

Related U.S. Application Data

(60) Provisional application No. 61/624,843, filed on Apr. 16, 2012.

(51) Int. Cl.
*F21V 21/08* (2006.01)
*F21V 21/00* (2006.01)

(52) U.S. Cl.
CPC ..... *F21L 15/08* (2013.01)

(58) Field of Classification Search
USPC ..... 362/197, 199, 191, 235
See application file for complete search history.

(56) References Cited

U.S. PATENT DOCUMENTS

| | | | | |
|---|---|---|---|---|
| 5,860,728 | A * | 1/1999 | Maglica | 362/191 |
| 2005/0254238 | A1* | 11/2005 | Parker et al. | 362/191 |
| 2010/0271832 | A1* | 10/2010 | McCorkle et al. | 362/396 |
| 2012/0099333 | A1* | 4/2012 | Wang | 362/396 |

* cited by examiner

*Primary Examiner* — Tracie Y Green
(74) *Attorney, Agent, or Firm* — Schmieser, Olsen & Watts LLP

(57) ABSTRACT

A flashlight mount for use on helmets and on equipment is provided. The mount includes a light holder, a clamp and fastening device. The light holder is rotatably coupled to the clamp, wherein the clamp operates to retain the light holder in a user selected orientation, thereby preventing rotation of the light holder. The clamp further includes a top clamp portion and bottom clamp portion, wherein in some embodiments, they are hingedly coupled together on a first end and the securing device repeatably and releasably clamping the top and bottom clamp portions together on second ends of the clamp portions by use of a securing device, or the clamp portion are fixed for receiving a protrusion from equipment or a helmet with a securing device for securing the clamp to the protrusion or helmet.

10 Claims, 7 Drawing Sheets

FLASHLIGHT MOUNT

CROSS REFERENCE TO RELATED APPLICATION[S]

This application claims priority to U.S. Provisional Patent Application to Christopher McCorkle entitled "FLASHLIGHT MOUNT FOR USE ON EQUIPMENT," Ser. No. 61/624,843, filed Apr. 16, 2012, the disclosure of which is hereby incorporated entirely herein by reference.

BACKGROUND OF THE INVENTION

1. Technical Field

This invention relates generally to a flashlight mount and particularly for a flashlight mount for use on helmets and on equipment.

2. State of the Art

There are frequent times when a flashlight is needed in order for a person to see in order to perform a task. For example, firefighters often need the use of a flashlight in order to see in dark buildings and in order to illuminate the surrounding area in order to perform the tasks required. In particular, a firefighter needs a light when the smoke surrounding the fire fighter affects visibility. The more a firefighter can see the better he or she is able to operate.

One aspect of a firefighter's responsibilities at times is to use equipment such as a ventilation saws, extrication tools, ventilation fans, mobile exhaust fans, and the like. Being able to see during the operation of the equipment is critical in order to avoid harm. Firefighters often use conventional light mounts that allow for a flashlight to be mounted to equipment. However, these conventional mounts have limitations. They are secured and not readily adjustable and not readily movable to various locations as needed for the task at hand. Other industries may utilize lights and suffer from similar limitations. For example, workers for utility companies during power outages have the need for flashlights.

DISCLOSURE OF THE INVENTION

The present invention relates to a flashlight mount for use on helmets and on equipment such as, but not limited to, a ventilation saws, extrication tools, ventilation fans, mobile exhaust fans, and the like, wherein the flashlight mount is easily attached and removed from the equipment.

An embodiment may include a flashlight mount comprising a light holder and a clamp. The light holder comprises a holder body; an aperture extending through the holder body from a front face through a rear face for receiving a flashlight there through; and a locking device for securing the flashlight within the light holder. The light holder is rotatably coupled to the clamp.

An embodiment may include a flashlight mount comprising a light holder, a clamp and a securing device. The light holder may comprise a holder body; an aperture extending through the holder body from a front face through a rear face for receiving a flashlight there through; and a locking device for securing the flashlight within the light holder. The light holder is rotatably coupled to the clamp. The clamp may comprise a top clamp portion and a bottom clamp portion that are hingedly coupled together on a first end. The securing device repeatedly and releasably secures the top and bottom clamp portions together on second ends of the clamp portions.

Another embodiments includes a flashlight mount comprising a flashlight with an integral light holder; a clamp, wherein the light holder is rotatably coupled to the clamp, the clamp comprising a top clamp portion and a bottom clamp portion that are hingedly coupled together on a first end; and a securing device that repeatedly and releasably secures the top and bottom clamp portions together on second ends of the clamp portions.

A method of using the flashlight mount may include the steps of opening a clamp of the flashlight mount and securing it to a component of a piece of equipment; positioning the light holder of the flashlight mount into a user selected orientation; retaining the light holder in the user selected orientation; and securing a flashlight within the light holder. The method may further include activating the flashlight and illuminating objects to be worked on with the piece of equipment.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures.

DETAILED DESCRIPTION OF EMBODIMENTS OF THE INVENTION

Figure 1:
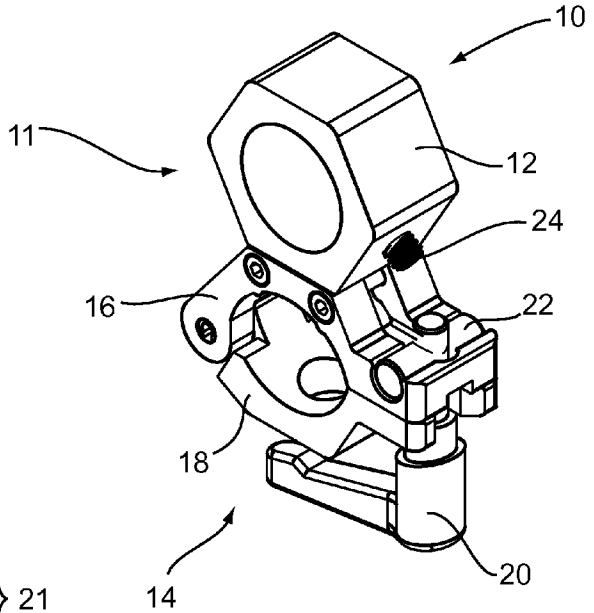
FIG. 1 is a perspective view of a flashlight mount.
Figure 2:
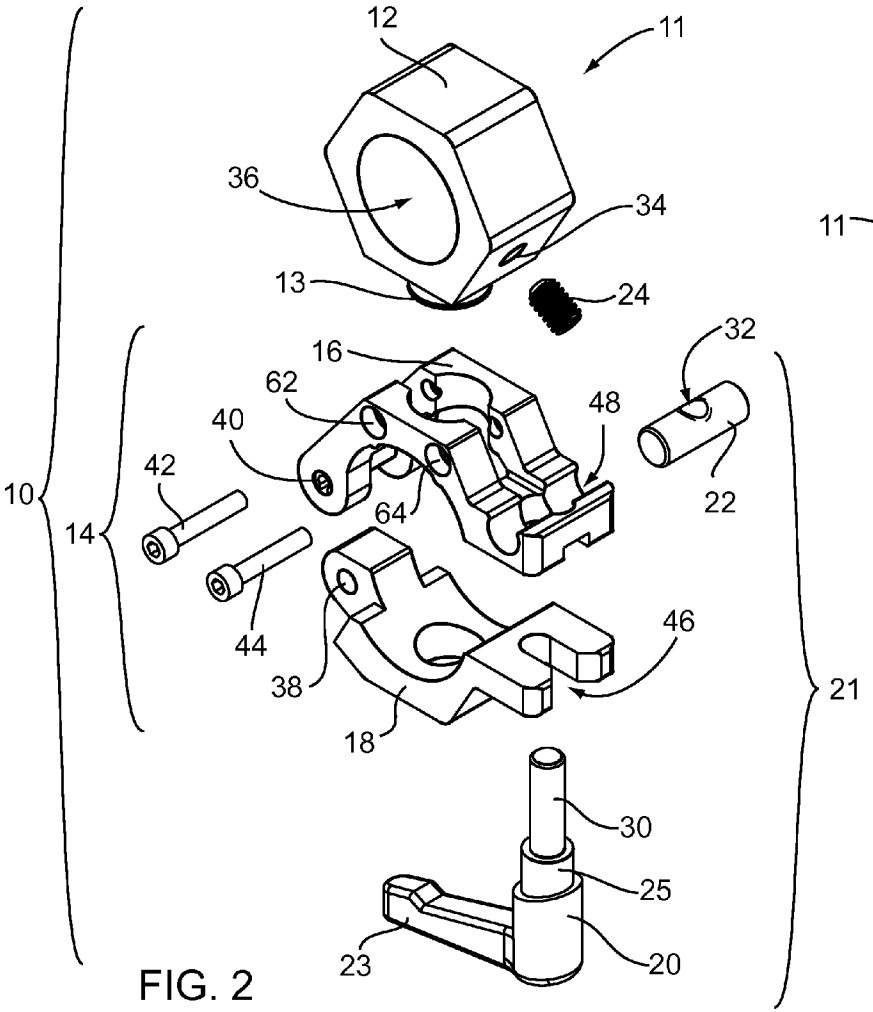
FIG. 2 is an exploded perspective view of a flashlight mount.
Figure 5:
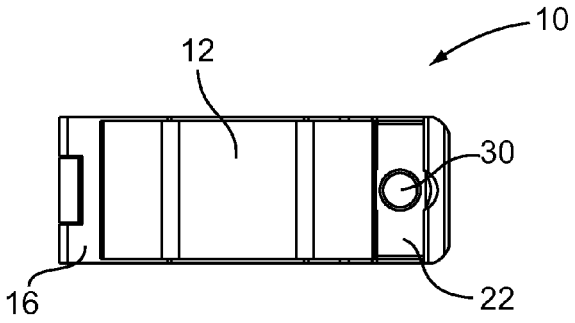
FIG. 5 is a top view of a flashlight mount.
Figure 3:
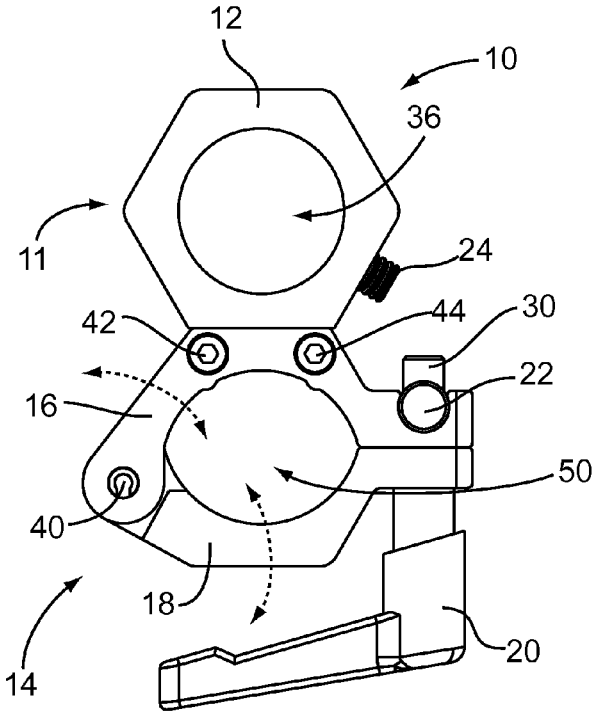
FIG. 3 is a side view of a flashlight mount.
Figure 4:
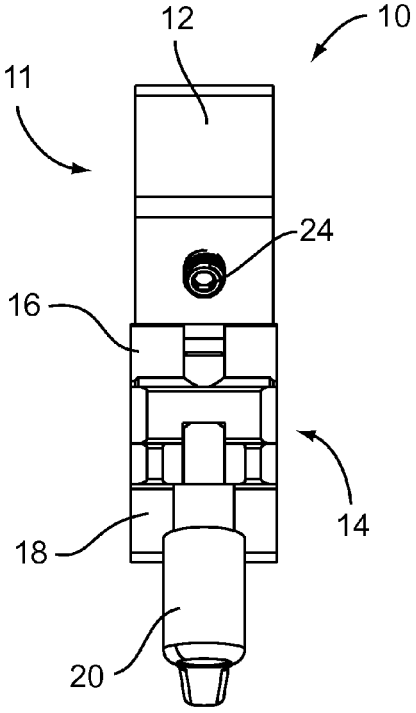
FIG. 4 is an end view of a flashlight mount.
Figure 6A:
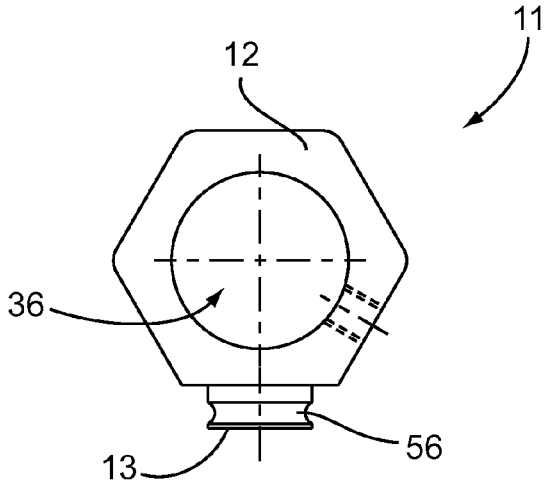
FIG. 6A a side view of a light holder of a flashlight mount.
Figure 6B:
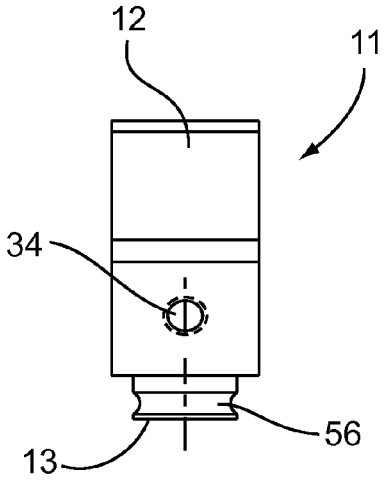
FIG. 6B is an end view of a light holder of a flashlight mount.
Figure 6C:
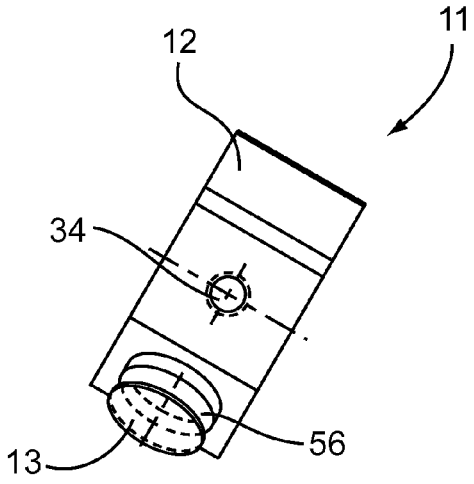
FIG. 6C is a perspective view of a light holder of a flashlight mount.
Figure 7A:
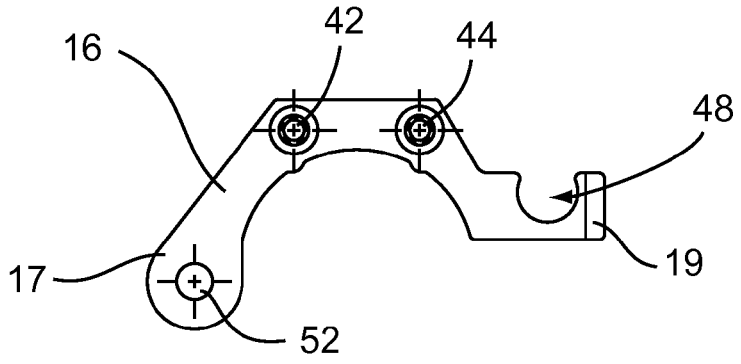
FIG. 7A is a side view of a top clamp portion of a flashlight mount.
Figure 7B:
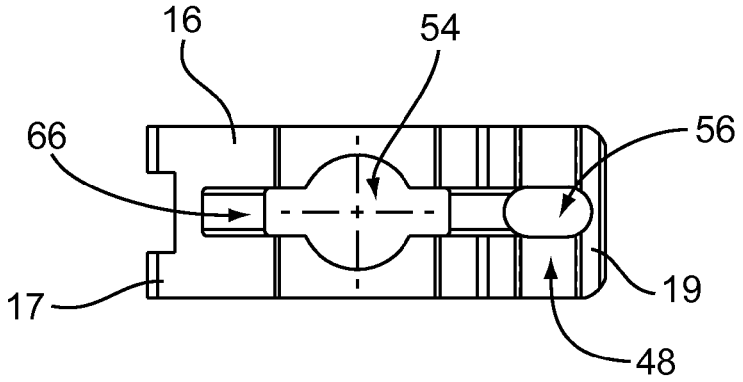
FIG. 7B is a top view of a top clamp portion of a flashlight mount.
Figure 7C:
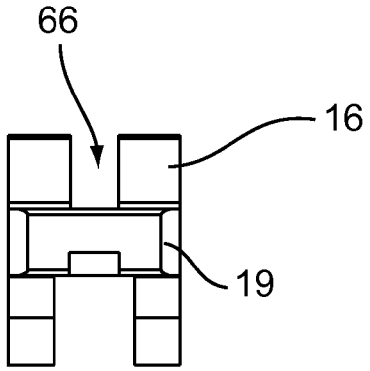
FIG. 7C is an end view of a top clamp portion of a flashlight mount.
Figure 8A:
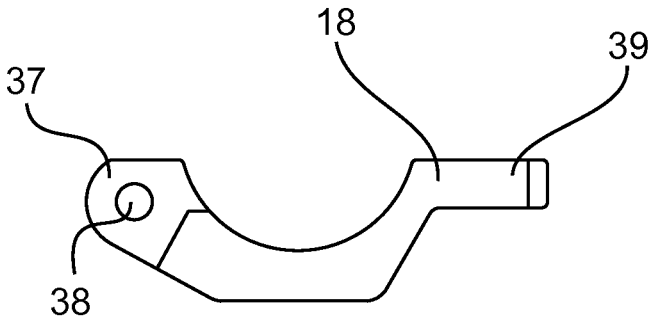
FIG. 8A is a side view of a bottom clamp portion of a flashlight mount.
Figure 8B:
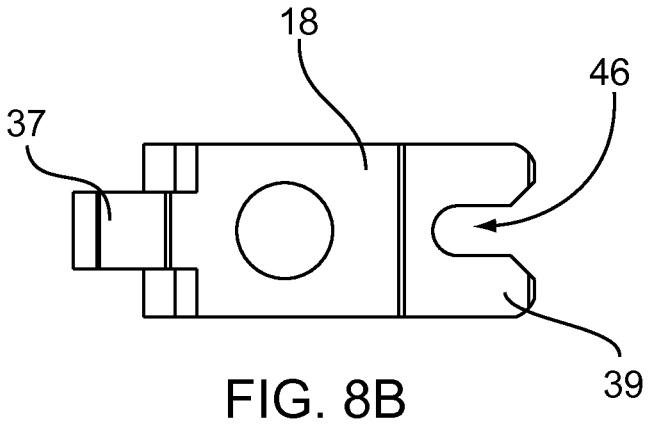
FIG. 8B is a top view of a bottom clamp portion of a flashlight mount.
Figure 8C:
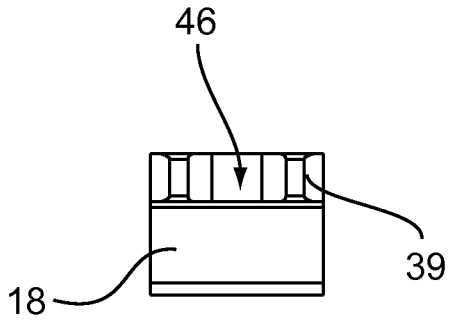
FIG. 8C is an end view of a bottom clamp portion of a flashlight mount.

As discussed above, embodiments of the present invention relate to a flashlight mount for use on helmets and on equipment such as, but not limited to, a ventilation saws, extrication tools, ventilation fans, mobile exhaust fans, and the like, wherein the flashlight mount is easily attached and removed from the equipment.

Referring to the drawings, FIGS. 1-8 depict a flashlight mount 10 for use on equipment. The mount 10 includes a light holder 11, a clamp 14 and securing device 21. The light holder 11 is rotatably coupled to the clamp 14.

As further shown in FIGS. 1-5 and 6A-6C, the light holder 11 comprises a holder body 12 with an aperture 36 extending from a front face through a rear face. The holder body 12 further comprises a securing aperture 34, wherein a locking device 24 may extend through the securing aperture 34 in order to secure a flashlight within the light holder 12. The holder body 12 further comprises a protrusion 13 having a concave surface 56, wherein in some embodiments, the concave surface 56 forms a half toroid shaped void around the protrusion 13. The aperture 36 is of a size and shape to receive a flashlight through the aperture 36. Once a flashlight is inserted within the aperture 36, the locking device 24 may engage the flashlight 36 through the securing aperture 34 and releaseably secure the flashlight within the aperture 36. At least in this way, the light holder 11 holds a flashlight.

In other embodiments of the present invention, the flashlight and the light holder are integral. In these aspects, the flashlight and the light holder are a single unitary component, wherein the flashlight holder combination component is mounted to the clamp 14.

As further shown in FIGS. 1-5, and 7A-8C, the clamp 14 may comprise a top clamp portion 16 with a first end 17 and a second end 19, and a bottom clamp portion 18 with a first end 37 and a second end 39. The top clamp portion 16 may be hingedly coupled to the bottom clamp portion 18 at the first ends 17 and 37 respectively. In some embodiments, the hinged coupling includes a hinge pin 40 that engages hinge aperture 52 of the top clamp portion 16 and the hinge aperture 38 of the bottom clamp portion 18. The hinge pin 40 acts as the axis of rotation or the clamp portions 16 and 18 with respect to each other, wherein the top and bottom clamp portions 16 and 18 are moveable between a clamped and an unclamped position along respective bi-directional arrows shown in dashed lines on FIG. 3. In the clamped position, the clamp portions 16 and 18 function to secure the mount 10 to a piece of equipment or the like, wherein the piece of equipment is received into the opening 50 formed between the top clamp portion 16 and the bottom clamp portion 18. In other words, the hinged coupling allows for the clamp 14 to be opened and positioned around, and releasably and repeatedly coupled to, a handle or other type of component of a piece of equipment or the like.

In order to releaseably secure the clamp 14 to a handle of a piece of equipment, the clamp further comprises a securing device 21. The securing device 21 comprises a quick release lock 20 having a shaft 30 extending therefrom. In particular embodiments, the shaft 30 is a threaded shaft. The shaft 30 is sized and shapes to extend through an engagement rod 22, wherein the engagement rod 22 includes a lock aperture 32 for operatively engaging the shaft 30. For example, the lock aperture 32 may be a threaded aperture that corresponds to the threads of the shaft 30. In this particular embodiment, the quick release lock 20 may be utilized to rotate the shaft 30 thereby extending or retracting the shaft 30 through the lock aperture 32. In order to make it easier to rotate the quick release lock, embodiments of the securing device 21 include a quick release lock 20 having a handle 23.

The securing device 21 operatively engages the top and bottom clamp portions 14. For example, the top clamp portion 16 comprises a channel 48 on the second end 19. The channel 48 also includes a securing aperture 56, wherein the securing aperture is an elongate aperture. The channel 48 corresponds to the engagement rod 22, wherein the engagement rod 22 engages the channel 48 and the securing aperture 56 of the top clamp portion 16 aligns with the lock aperture 32 of the rod 22. The alignment of the securing aperture 52 and the lock aperture 32 allows for the shaft 30 of the quick release lock 20 to extend through the securing aperture 56 in order to operatively engage the lock aperture 32 of the rod 22.

The securing device 21 also engages the bottom clamp portion 18. In order to accomplish this, embodiments of the bottom clamp portion 18 comprise a notch 46 on the second end 39. The notch 46 has an opening that allows the shaft 30 of the quick release lock 20 to slide in an out of the notch, wherein with the shaft in the notch, the clamp is in a clamping position and with the shaft out of the notch, the clamp is in an open position. In operation with the clamp 14 in the clamping position, as the quick release lock 20 is rotated and the shaft 30 extends further through the lock aperture 32 to place the securing device 21 in a clamping position, the clamping member 25 engages a bottom side of the bottom clamp portion 18 adjacent the notch 46 and moves the top and bottom clamp portion 16 and 18 toward each other in order to clamp around a handle of the piece of equipment or the like.

In addition, total operation of the clamp 14 with the securing device 21, the quick release lock 20 does not need to be completely disengaged from the engagement rod 22 in order for the clamp to open to engage a handle of the piece of equipment or the like. The quick release lock 20 may be rotated to retract the shaft 30 through the lock aperture 32 of the rod 22. The shaft 30 may be retracted such that an end of the shaft is still engaged with the engagement rod 22. The channel 48 corresponds to the shape of the rod 22, wherein both are cylindrical in shape allowing for a rotational relationship. The partial retraction of the rod 30 disengages the clamping member 25 of the quick release lock 20 from the bottom clamp portion 18. In this condition, the mount 10 may be rotated about the handle, bar or other component of the piece of equipment and then tightened again. Also, in this condition, the securing device may be rotated away from the clamp 14, wherein the shaft 30 is removed from the notch 46, allowing the bottom clamp portion 18 to rotate about the hinge pin 40. The securing aperture 52 of the top clamp portion 16 sets the range of rotation of the securing device 21 with respect to the clamp 14. When is desired to couple the clamp 14 to a handle, the reverse operation can be utilized in order to secure the clamp 14 to a handle of a piece of equipment.

The top clamp portion 16 further comprises a holder aperture 54 extend through the top clamp portion 16 from the top side. The holder aperture 54 is sized and shaped to receive the protrusion 13 of the light holder 11. The top clamp portion 16 may further comprise two retaining apertures 62 and 64 extending through the top clamp portion 16 through the sides of the top clamp portion, such that the axes of the retaining apertures 62 and 64 are transverse to the axis of the holder aperture. Additionally, the retaining apertures 62 and 64 may overlap opposing ends of the holder aperture 54. In operation, the protrusion 13 of the light holder 11 is inserted within the holder aperture 54 of the top clamp portion 16. Once the protrusion 13 is within the holder aperture 54, securing pins 42 and 44 may be engaged within retaining apertures 62 and 64 respectively. The securing pins 42 and 44 function to retain the protrusion within the holder aperture 54 of the top clamp portion 16. The securing pins 42 and 44 may be threaded and the retaining apertures 62 and 64 may include corresponding threads. Further, the securing pins 42 and 44 when engaged in the retaining apertures 62 and 64 also engage the concave surface 56, thereby retaining the protrusion 13 within the holder aperture 54.

The top clamp portion 16 also comprises a channel 66 extending from the first end 17 to the second end 19. The retaining apertures 62 and 64 intersect the channel 66. This allows the retaining pins 42 and 44 to be tightened and thereby reduce the width of the channel, thereby reducing the radius of the holder aperture 54 to engage the sides of the protrusion 13. This further serves to retain the light holder 11 in a particular orientation. For example, with the retaining pins 42 and 44 engaged within the retaining apertures 62 and 64 and the channel 66 at its greatest width, the light holder is retained, but is rotatable. Accordingly, a user may operate the clamp 14 to secure the mount 10 to a piece of equipment handle and then rotate the light holder 11 until it reaches a user desired orientation. The user may then tighten the retaining pins 42 and 44 to secure the light holder in the particular orientation.

Further, a user may tighten the retaining pins 42 and 44 in order reduce the radius of the holder aperture 54 until there is a friction. In this embodiment, the friction may be an active friction wherein the user may apply manual force greater than the active friction to rotate the light holder 11 until it is in a desired position and the active friction is such that the light holder is maintained in that position. Accordingly, the user may apply manual force to rotate the light holder to any position desired and the active friction caused by the reduction of the radius of the holder aperture functions to maintain the user selected position.

Figure 11:
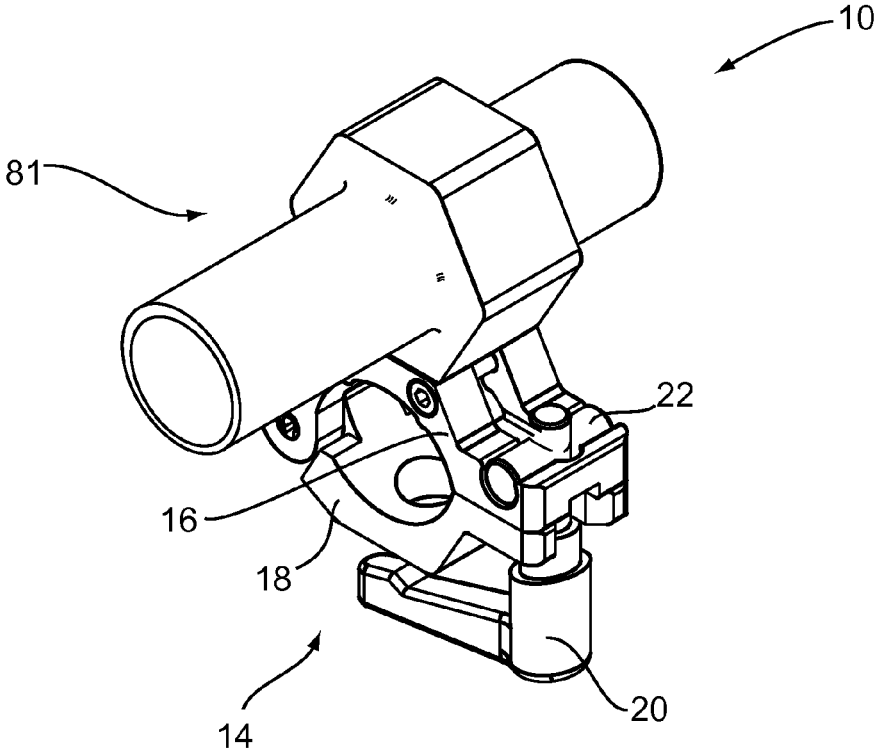
FIG. 11 is a perspective view of a flashlight mount with a light holder integral with a flashlight.

In another embodiment, as shown in FIG. 11, a flashlight mount 10 is provided for use on equipment. The mount 10 includes a flashlight with integral light holder 81, a clamp 14 and securing device 21. The flashlight with integral light holder 81 is rotatably coupled to the clamp 14. The clamp 14 comprises a top clamp portion 16 and a bottom clamp portion 18 that includes all of the features and functions as the clamp 14 has been previously described. Additionally, the securing device 21 includes a quick release lock 20 and engagement rod 22 that includes all of the features and functions as the securing device 21 has been previously described.

Figure 10:
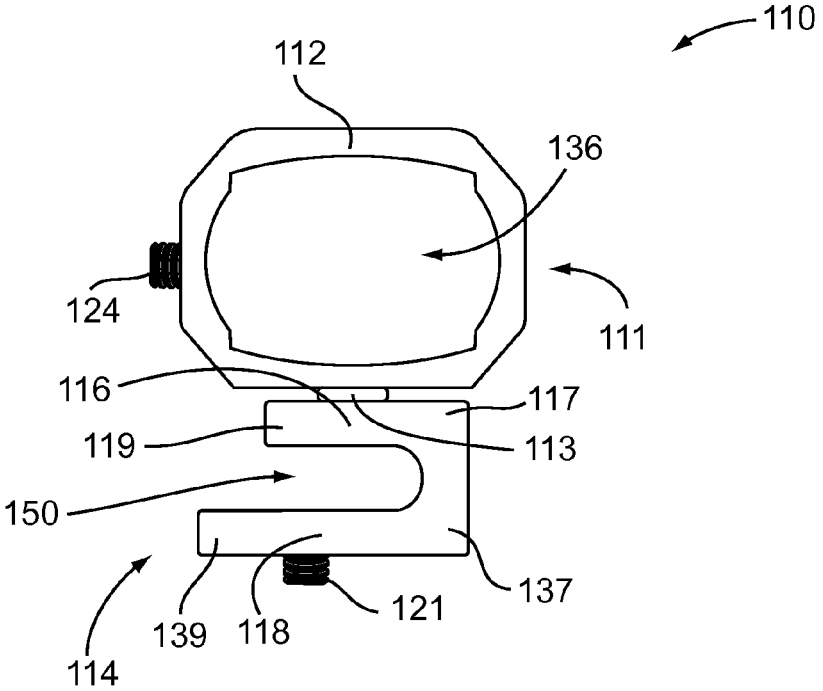
FIG. 10 is a side view of a flashlight mount.

In another embodiment shown in FIG. 10, a flashlight mount 110 is shown. The mount 110 includes a light holder 111, a clamp 114 and securing device 121. The light holder 111 is rotatably coupled to the clamp 114 by use of coupling device 113. The coupling device 113 allows for rotation of the light holder 11 with respect to the clamp 114. Further, the coupling device 13 may have a friction fit, where force is required to rotate the light holder with respect to the clamp 114, wherein the frictional force maintains the light holder 111 in the orientation set by the user. In other embodiments, the coupling device 113 may be tightened and loosened in order to allow for rotation of the light holder 111 when in a loosened condition and once the orientation of the light holder 111 is determined, moving the coupling device 113 into a tightened condition to maintain the orientation of the light holder 111.

The light holder 111 comprises a holder body 112 with an aperture 136 extending from a front face through a rear face of the holder body 112. The holder body 112 further comprises a securing aperture, wherein a locking device 124 may extend through the securing aperture in order to secure a flashlight within the light holder 111. The aperture 136 is of a size and shape to receive a flashlight through the aperture 136. Once a flashlight is inserted within the aperture 136, the locking device 124 may engage the flashlight 136 through the securing aperture and releasably secure the flashlight within the aperture 136. At least in this way, the light holder 111 holds a flashlight.

The clamp 114 may comprise a top clamp portion 116 with a first end 117 and a second end 119, and a bottom clamp portion 118 with a first end 137 and a second end 139. The top clamp portion 116 may be coupled to the bottom clamp portion 118 at the first ends 117 and 137 respectively, wherein an opening 150 is maintained between the second ends 119 and 139 and a portions of the top and bottom clamp portions 116 and 118.

In order to releasably secure the clamp 114 to a piece of equipment, such as a helmet or a tool, the clamp 114 further comprises a securing device 121. A piece of equipment may be received into the opening 150 formed between the top clamp portion 116 and the bottom clamp portion 118. The securing device 121 may then be moved from a loosened to a tightened position, wherein in the tightened position, the securing device 121 engages the piece of equipment. The movement of the securing device to the tightened position places the clamp 114 in the clamped position. Movement of the securing device 121 to the loosened position places the clamp 114 in the unclamped position.

Figure 9:
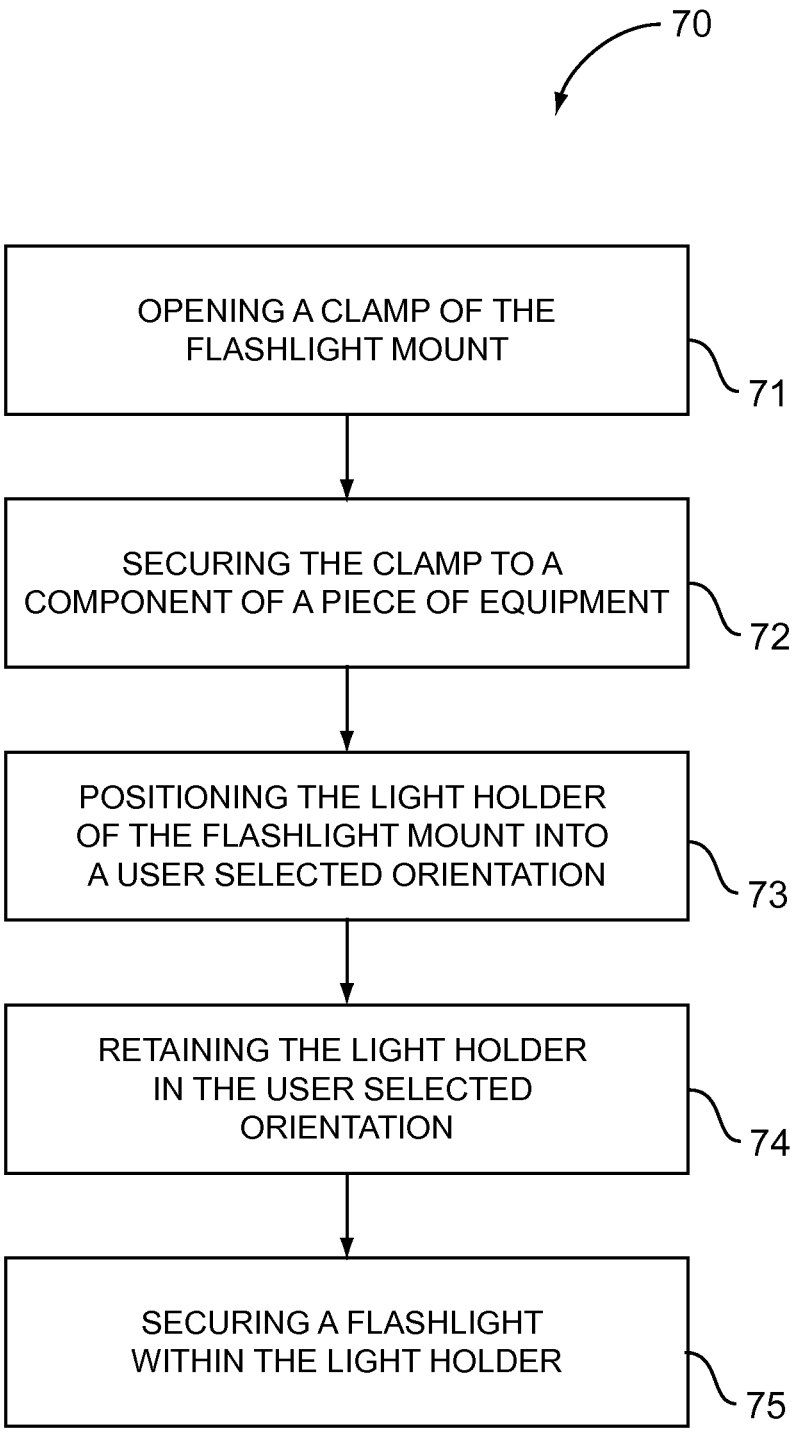
FIG. 9 is a flow chart of a method of using a flashlight mount.

Referring further to the drawings, FIG. 9 depicts a method 70 of using a flashlight mount. The method 70 comprises opening a clamp of the flashlight mount (Step 71); securing the clamp to a component of a piece of equipment (Step 72); positioning the light holder of the flashlight mount into a user selected orientation (Step 73); retaining the light holder in the user selected orientation (Step 74); and securing a flashlight within the light holder (Step 75). The method 70 may further include activating the flashlight and illuminating objects to be worked on with the piece of equipment.

It will be understood that while this method includes the use of a light holder as part of the mount, other embodiments include a flashlight with an integral light holder. Instances wherein light holder is discussed can be substituted with a flashlight with an integral light holder.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A flashlight mount comprising:

a light holder comprising:

a holder body;

an aperture extending through the holder body from a front face through a rear face for receiving a flashlight there through; and a locking device for securing the flashlight within the light holder;

a clamp, wherein the light holder is rotatably coupled to the clamp, the clamp comprising a top clamp portion and a bottom clamp portion that are hingedly coupled together on a first end, wherein the top clamp portion comprises a channel on the second end, the channel including a securing aperture and the bottom clamp portion comprises a notch on the second end; and a securing device, comprising a quick release lock having a shaft and an engagement rod having a lock aperture for operatively engaging the shaft, that repeatedly and releasably secures the top and bottom clamp portions together on second ends of the clamp portions.

2. The flashlight mount of claim 1, wherein the clamp operates to retain the light holder in a user selected orientation.

3. The flashlight mount of claim 1, wherein the light holder further comprises a protrusion extending from the holder body.

4. The flashlight mount of claim 3, wherein the clamp further comprises an aperture in the top clamp portion for receiving the protrusion of the light holder.

5. The flashlight mount of claim 4, wherein the clamp further comprises a securing pin, wherein the securing pin retains the protrusion of the light holder within the aperture of the clamp while allowing the light holder to rotate with respect to the clamp.

6. The flashlight mount of claim 1, wherein the securing aperture is an elongate aperture.

7. The flashlight mount of claim 1, wherein the engagement rod engages the channel of the top clamp portion and the securing aperture of the top clamp portion aligns with the lock aperture of the engagement rod.

8. The flashlight mount of claim 7, wherein the shaft of the quick release lock extends through the securing aperture and operatively engages the lock aperture of the engagement rod.

9. The flashlight mount of claim 8, wherein the notch of the bottom clamp portion comprises an opening that allows the shaft of the quick release lock to slide in an out of the notch, wherein the clamp is in a clamping position with the shaft in the notch and in an open position with the shaft out of the notch.

10. The flashlight mount of claim 9, wherein, with the clamp in the clamping position, the quick release lock is rotated and the shaft extends further through the lock aperture, such that a clamping member of the quick release lock engages a bottom side of the bottom clamp portion adjacent the notch and moves the top and bottom clamp portions toward each other.

* * * * *